US006570048B1

(12) United States Patent
Getman et al.

(10) Patent No.: US 6,570,048 B1
(45) Date of Patent: May 27, 2003

(54) METHOD FOR OXIDIZING ORGANOPHOSPHOROUS COMPOUNDS

(75) Inventors: Gerry D. Getman, McMurray, PA (US); Wood E. Hunter, The Woodlands, TX (US); Rudolph H. Moyer, Montgomery Village, MD (US)

(73) Assignee: Commodore Applied Technologies, Inc., New York, NY (US)

( * ) Notice: Subject to any disclaimer, the term of this patent is extended or adjusted under 35 U.S.C. 154(b) by 0 days.

(21) Appl. No.: 09/602,488

(22) Filed: Jun. 23, 2000

(51) Int. Cl.[7] ..... A62D 3/00
(52) U.S. Cl. ..... 588/200; 588/221
(58) Field of Search ..... 588/200, 202, 588/203, 205, 221

(56) References Cited

U.S. PATENT DOCUMENTS 4,108,746 A * 8/1978 Mill et al. ..... 204/158 R
4,260,494 A * 4/1981 Dotson et al. ..... 210/721
5,678,243 A * 10/1997 Yang et al. ..... 588/200
5,859,064 A * 1/1999 Cronce ..... 514/643
5,976,348 A * 11/1999 Pugh ..... 205/688
5,998,691 A 12/1999 Abel et al. ..... 588/200
6,080,906 A * 6/2000 Johnson et al. ..... 588/200
6,342,639 B1 * 1/2002 Campbell et al. ..... 568/52

OTHER PUBLICATIONS

"Destruction of VX by Aqueous–Phase Oxidation Using Peroxydisulfate (Direct Chemical Oxidation)" John F. Cooper, Roger Krueger and Joseph C. Farmer—Lawrence Livermore National Laboratory—Livermore CA 94550 Workshop on Advances in Alternative Demilitarization Technologies Reston, Virginia 25–27 Sep. 1995.

* cited by examiner

*Primary Examiner*—Stanley S. Silverman
*Assistant Examiner*—Anthony Kuhar
(74) *Attorney, Agent, or Firm*—Howard M. Ellis

(57) ABSTRACT

Organophosphorous compounds containing C—P chemical bonds are oxidized with alkaline peroxysulfate to yield orthophosphates. For example, phosphinates, including certain chemical warfare agents, as well as phosphinate salts produced by the solvated electron reduction of the chemical warfare agents, are oxidized to orthophosphates.

23 Claims, No Drawings

METHOD FOR OXIDIZING ORGANOPHOSPHOROUS COMPOUNDS

This invention is in the field of chemical processes; more specifically, this invention relates to methods for oxidizing organic compounds whose molecular structures include at least one carbon-phosphorous bond. The process is especially useful in the oxidation of organic phosphinates to inorganic orthophosphates.

BACKGROUND OF THE INVENTION

In a broad sense, organophosphorous compounds contain at least one phosphorous atom chemically bonded directly or indirectly to a carbon skeleton. The phosphorous atom may be a member of an organic chain or ring system in which phosphorous is bonded directly to carbon, or phosphorous may be the central atom in a functional group which in turn is bonded to a carbon-containing chain or ring. Such functional groups commonly have one or more oxygen atoms or hydroxyl (—OH) groups surrounding the phosphorous atom.

Examples of organophosphorous compounds in which phosphorous is bonded directly to carbon include: phosphines $R_3P$, phosphine oxides $R_3PO$, phosphonic acids $RP(O)(OH)_2$, phosphonous acids $RPH(O)(OH)$, phosphinous acids $R_2POH$, phosphoranes $R_3P{=}CH_2$, and biphosphines $R_2P{-}PR_2$. Examples of organophosphorous compounds in which phosphorous is bonded both directly and indirectly to carbon include phosphonates $RP(O)(OR')_2$, phosphonites $RPH(O)(OR')$, phosphinites $R_2P(OR')$, phosphonamides $RP(O)(NR'R'')_2$, and phosphinamides $R_2P(NR')$. The alkyl phosphonates and phosphinates are related to phosphonic acid $HP(O)(OH)_2$ and phosphinic acid $H_2P(O)OH$, respectively. In all of these examples the R, R' and R" moieties can be the same or different and any combination of alkyl or aromatic groups. Further examples of the large number of these compounds can be found in the seminal textbook "Organophosphorous Compounds" by G. Kosolapoff, John Wiley and Sons, New York, N.Y., 1950.

The organophosphorous compounds within the scope of this invention all contain phosphorous directly bonded to carbon. The compounds additionally may include phosphorous indirectly connected to carbon, but the structural feature of the organophosphorous compounds central to the process of this invention is:

$$P{-}C \qquad \text{(I)}$$

Although the process of this invention is of general utility, it is especially useful when applied to organophosphorous compounds represented generally by chemical structure II:

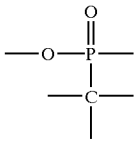

(II)

The compounds of formula II are called "phosphinates."

Within the set of the phosphinates of structure II is a subset, a number of which are chemical warfare agents; more specifically, the subset includes some extremely toxic cholinesterase inhibitors, i.e., nerve agents. This subset is included in the compounds represented by formula III:

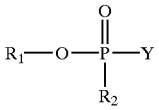

(III)

in which $R_1$ is selected from hydrogen and alkyl, $R_2$ is independently selected from alkyl, and Y is a leaving group.

Destruction of chemical warfare agents, including nerve agents within the scope of formula III, is the subject of PCT Application WO 97/18858, published May 29, 1997 and counterpart U.S. Pat. 5,598,691, dated Dec. 7, 1999, either or both of which are referred to as "the earlier patent" hereinafter and are incorporated herein by reference. Included in the disclosure of the earlier patent is a preferred process for destroying chemical warfare agents by subjecting them to a "dissolving metal reduction." The reduction involves creating a reaction mixture prepared from raw materials which include nitrogenous base, e.g., anhydrous liquid ammonia, at least one chemical warfare agent, e.g., a nerve agent of formula III, and an active metal, such as sodium. The dissolving metal reaction generates solvated electrons, a highly active reducing agent. The reduction reaction results in a product which includes, among other substances, the phosphinate salts represented by formula IV:

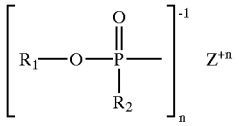

(IV)

in which $R_1$ and $R_2$ are the same as in formula III, and Z is a cation of charge n. Noteworthy is the fact that the salts of formula IV still contain phosphorous-carbon bonds $P{-}R_2$.

The earlier patent suggests oxidation of the product from reduction of the chemical warfare agent in order to simplify its disposal as waste. However, the suggested oxidation with agents, such as hydrogen peroxide may leave some of the $P{-}R_2$ phosphorous-carbon bonds intact. The continued presence of phosphorous-carbon bonds raises toxicity issues and presents additional waste disposal problems.

SUMMARY OF THE INVENTION

Thus, it would be beneficial to provide a method for breaking the carbon-phosphorous bonds found in the organophosphorous compounds of the aforesaid formulae in order to provide a new synthetic route to useful materials and also to reduce the toxicity of the organophosphorous compounds of the aforesaid formulae and render them more environmentally acceptable.

Therefore, it is an objective of this invention to provide a method for attaining these ends starting with organophosphorous compounds having the structural feature of formula I. It is another objective to provide a process which is especially applicable to break the carbon-phosphorous bonds in organophosphorous compounds within the scope of formula II. Yet another objective is to provide a unique method for destroying, i.e, breaking the carbon-phosphorous bond in the phosphinates of formula III, including destruction of those compounds of formula III which are chemical warfare agents. It is still another objective to provide a method for oxidizing compounds of formula IV, especially as a follow-up to the dissolving metal reduction of the chemical warfare agents within the scope of formula III, thereby decreasing the toxicity of the reduction products and simplifying their disposal as waste.

Accordingly, in attaining the aforesaid objectives this invention provides a process for converting organophosphorous compounds of formulae II, III, and IV, all of which contain the structural feature of formula I, into relatively benign organic compounds and inorganic salts which often are soluble in water and are relatively safe, environmentally.

In order to accomplish these objectives, it is preferred to treat the organophosphorous compounds with an oxidizing agent comprising a peroxysulfate of formula V, $$M_2S_xO_y \qquad (V)$$

in which M is a monovalent cation, x is 1 or 2, y is 5 when x is 1, and y is 8 when x is 2; $M_2SO_5$ is a peroxymonosulfate, while $M_2S_2O_8$ is a peroxydisulfate. The process is preferably carried out in the presence of water, and in addition, should be conducted in an alkaline pH range. This is in contrast to the methods of John F. Cooper, et al, described in a paper entitled "Destruction of VX by Aqueous-Phase Oxidation Using Peroxydisulfate (Direct Chemical Oxidation)" presented at the Workshop on Advances in Alternative Demilitarization Technologies, Reston, Va., Sep. 25–27, 1995. The oxidation processes of Cooper et al were carried out using acidified ammonium peroxydisufate with pHs adjusted down to 1.5. Unlike the methods of Cooper et al, these inventors found that although some reaction occurs in the acid pH range, cleavage of the carbon-phosphorus bond is greatly facilitated when performed under alkaline conditions, i.e., pH>7, and at elevated temperatures. The addition of base, such as sodium hydroxide also allows lesser amounts of the peroxysulfate to be used, making it more economic.

The chemistry of peroxysulfate oxidation/reduction, including kinetics and mechanism, has been described in I. M. Kolthoff and I. K. Miller, *J. Am. Chem. Soc.*, 73, 3055 (1951) and in L. S. Levitt, *Can. J. Chem.*, 31, 918 (1963). The oxidation of methylphosphonic acid, $CH_3P(O)(OH)_2$, using ozone/oxygen at pH 8–8.5 in aqueous sodium bicarbonate to yield phosphoric acid has been reported; see V. V. Smirnov, et al., *Zh. Obshch. Khim.*, 37(12) 2783–4 (1967); C.A. 68:113762x. Related disclosures are found in *Zh. Obshch. Khim.*, 38(5) 1197 (1968); C.A. 69 77373f and *Zh. Obshch. Khim.*, 39(4) 932 (1969); C.A. 71 56020q. The oxidation with aqueous $HNO_3/KMnO_4$ of a series of compounds $RPO_3H_2$ in which R is alkyl is described in *Dokl. Akad. Nauk. SSSR*, 167(6) 1303–5 (1966); C.A. 65 3902b.

The result of the process is to break at least one carbon-phosphorous bond, typically yielding a phosphorous-containing acid or a salt thereof, depending upon the nature of the cation M, pH and the substituents bonded to phosphorous. For example, in the general case and employing a peroxydisulfate, the structural feature of formula I undergoes the reaction shown in chemical equation VI:

$$P{-}C + \tfrac{1}{2}M_2S_2O_8 + H_2O + MOH \rightarrow P{-}OM + HO{-}C + MHSO_4 \qquad (IV)$$

While specifically illustrated with the organophosphorous structure of formula I, those skilled in the art will be able to extend the process readily to other organophosphorous compounds, including, but not limited to, the compounds of formulae II, III and IV. For example, oxidation of a phosphinate salt of formula IV according to the process of this invention leads to orthophosphoric acid or a salt thereof depending upon the specifics of the reactants employed as shown in chemical equation VII (when Z=M=$Na^+$).

(VII)

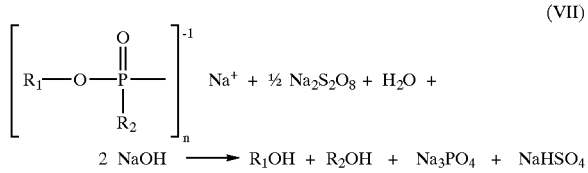

DETAILED DESCRIPTION OF THE INVENTION

Whereas organophosphorous compounds with the structural features of formulae I–IV, as well as mixtures thereof, can be oxidized using the process of this invention, those skilled in the art will understand that the path taken and the results achieved may vary, depending upon a number of factors. For example, the organophosphorous compound desired to be oxidized may contain other structural features which will interfere with the peroxysulfate oxidizing agent, such as other oxidizable groups. This can lead to side reactions. Peroxysulfate salts are generally employed in aqueous media, but if the organophosphorous compound is not soluble in water, the course of the perhaps heterogeneous reaction becomes uncertain. In addition, while an important feature of the invention includes conducting the oxidation reaction at an alkaline pH, i.e. pH>7, and more specifically, at a pH in the range of about 8 to about 12, or more, this may, in some circumstances, adversely affect other features on the molecule, e.g., may hydrolyze ester functionality.

Thus, application of the process of this invention requires the knowledge and skill possessed by trained chemists or chemical engineers after careful consideration of the nature of the organophosphorous reactant.

In applying the process of this invention to break a carbon-phosphorous bond, a solution of peroxysulfate of formula V in water is advantageously employed. The cationic moiety M in formula V can be, e.g., an alkali metal, such as $Na^+$ or $K^+$, as well as $NH_4^+$, e.g., sodium peroxydisulfate (or sodium persulfate), ammonium peroxymonosulfate, all of which are available through ordinary channels of commerce. Mixtures of peroxysulfates, etc., can also be utilized.

As previously mentioned, in addition to the peroxysulfate and water, the reaction mixture contains base. Although a wide variety of bases can be used, good results are obtained, and less expense incurred by employing strong base, such as, for example, the hydroxides of alkali and alkaline earth metals or mixtures thereof. Specific examples include the hydroxides of lithium, sodium, potassium, calcium and magnesium; among these, sodium hydroxide is readily available at reasonable cost, and so is preferred. Base is employed in quantities sufficient to achieve the alkaline pH ranges discussed hereinabove.

The reaction mixture can be created using various orders of addition. In general, the reaction mixture preferably is created by heating a mixture of water, an organophosphorous compound containing the structural feature of formula I, e.g., an organophosphinate of formula II, III, IV, or a mixture thereof, and base in a stirred vessel under atmospheric or higher pressure. The vessel is generally equipped with a condenser, optionally topped with a gas collection device. Sufficient aqueous peroxysulfate of formula V is added slowly to the mixture at a rate so as to maintain a temperature below about 100° C.

Typically, for each 1.0 part by weight organophosphorous compound, about 5–200 parts by weight water, about 5–100 parts peroxysulfate by weight, and up to about 50 parts of base, such as sodium hydroxide, by weight will be combined to create the reaction mixture.

The process of this invention can be applied to compounds containing the structure of formula II, including that subset of organophosphinates represented by formula III. The products of the reaction generally include a phosphate, also called an orthophosphate, derived from phosphoric acid, $H_3PO_4$.

In formula III, Y is an atomic grouping which is energetically stabile as an anion, the more preferred leaving groups being those which are most readily displaced from carbon in nucleophilic substitutions and, as anions, have the greatest stability. Although a host of such leaving groups are well known, it is preferred that the leaving group Y be selected from halogen, nitrile (—CN), and sulfide (—S—). These are the groups Y present in the organophosphinates of greatest interest as nerve agents. Among the halogens, it is most preferred that Y be fluorine, chlorine or bromine, fluorine being especially effective in the most readily available nerve agents, such as "Soman" or "GD."

$R_1$ and $R_2$ in formulae II and III can both be alkyl, and when they are, they can be the same or different; they can be selected independently from alkyl, preferably lower alkyl, i.e., $C_1$–$C_6$, straight chain, branched or cyclic, e.g., methyl, ethyl, propyl, iso-propyl, iso-butyl, tert-butyl, cyclohexyl, or trimethylpropyl. $R_1$ in the most widely distributed nerve agents is methyl, ethyl or 1,2,2-trimethylpropyl.

Specific agents within the scope of formula III include, e.g., "Sarin," or "GB," or methylphosphonofluoridic acid 1-methyl ethyl ester, or isopropyl methyl phosphonofluoridate; "Soman," or "GD," or methylphosphonofluoric acid 1,2,2-trimethylpropyl ester, or pinacolyl methyl phosphonofluoridate; and "VX," if or methylphosphonothioic acid S-[2-[bis (1-methyl ethyl)amino]ethyl]ethyl ester, or ethyl S-2-diisopropyl aminoethyl methylphosphoro-thioate.

In carrying out the oxidation of this invention with an organophosphinate of formula II or III, reaction mixtures preferably are prepared utilizing, for each 1.0 g phosphinate, about 5–200 g water, about 5–100 g peroxysulfate, e.g., sodium peroxydisulfate, and up to about 50 g base, e.g., sodium hydroxide. The preferred procedure involves preparing a solution of the base in water with stirring and control of the temperature so as not to exceed about 85° C. The organophosphinate is then added to the basic solution at a rate such that the temperature of the mixture does not exceed about 85° C. Finally, the peroxysulfate is added, preferably as an aqueous solution, so as to maintain the temperature of the mixture at about 85° C.–95° C. Crystalline peroxydisulfate containing 32.5% water is available as a commercial product.

If the phosphinate starting material is a chemical warfare agent, reference should be made to the earlier patent for general handling procedures. Upon completion of the reaction, especially if the phosphinate reactant is a nerve agent, the product can be analyzed for cholinesterase inhibition should residual biological activity be of interest; see. e.g., M. Waters, "*Laboratory Methods for Evaluating Protective Clothing Systems Against Chemical Agents*," CRDC-SP-84010, U.S. Army Armament, Munitions & Chemical Command, Aberdeen Proving Ground, Md. 21010 USA, June 1984. The product, substantially free of carbon-phosphorous bonds, can be retained for further reaction or safely disposed of.

Oxidation of phosphinate salts of formula IV can be carried out by the process of this invention regardless of their source. In formula IV, $Z^{+n}$, a cation of charge n, can be selected from $NH_4^+$; alkali metals cations, such as $Li^+$, $Na^+$ or $K^+$; alkaline earth metal cations, such as $Ca^{+2}$, $Ba^{+2}$ or $Mg^{+2}$; as well as $Al^{+3}$, $Ti^{+4}$, and so forth. In many cases $Z^{+n}$ will be an alkali metal cation, such as sodium, for reasons of cost and availability.

Should the salt of formula IV be available in solid form, a weighed amount can be dissolved in a measured quantity of water. If the salt is contained in anhydrous liquid ammonia or other nitrogenous base, e.g., as the product from the dissolving metal reduction of a phosphinate of formula III, water in measured amount can be added cautiously to the mixture in order to decompose any residual active metal. This will yield an aqueous solution from which the ammonia or other nitrogenous base can be substantially removed, e.g., by evaporation.

The amount of phosphinate salt in the aqueous solution, if unknown, can be determined by isolating and weighing the salt, or spectroscopic techniques, optionally with reference to independently prepared standards, can be employed. Alternatively, if previous experience permits, one can assume that a certain fraction (generally 100%) of the starting organophosphorous compound has been converted to phosphinate salt. In these ways the weight of solution containing 1.0 g of the phosphinate salt reactant can be ascertained.

Reaction mixtures are prepared per about 1.0 g phosphinate salt of formula IV, about 5–200 g water, about 5–100 g peroxydisulfate, e.g., sodium peroxydisulfate, and sodium hydroxide to about 50 g, and more particularly, from about 4 to about 50 g. The orthophosphate salt or acid produced can be quantified by using a standard molybdate calorimetric test or by ion chromatography. Preferably, for 1.0 g phosphinate salt, about 25–0 g water, about 5–50 g peroxydisulfate, and about 4–40 g base are used to prepare the reaction mixture. Most preferably, about 10–15 g sodium peroxydisulfate, about 6–30 g sodium hydroxide, and about 40–100 g water are used for each 1.0 g of phosphinate salt. It will be evident that the amounts of the reactants can be scaled up or down, depending upon the size of the equipment and the identities of the specific reactants.

The result of carrying out the process of this invention is generally influenced more by the amount of the peroxysulfate of formula V used than by any other single variable, while varying the amount of water within the stated limits usually has minimal effect. Under optimum conditions, the process results in a quantitative yield of orthophosphate or orthophosphoric acid, depending upon the pH.

Attention is directed to the following specific Examples which illustrate the process of this invention. The scope of the invention is limited, however, not by the specific Examples selected to illustrate it, but only by the appended claims.

EXAMPLES

In order to carry out the molybdate analysis for orthophosphate, an ammonium molybdate solution was prepared by adding 2.5 g of ammonium molybdate to about 50 $cm^3$ of deionized water. With cooling, 25 $cm^3$ of concentrated sulfuric acid was slowly added. The solution was diluted to the mark in a 100 $cm^3$ volumetric flask. A solution of stannous chloride was prepared by dissolving 2.5 g of stannous chloride in 6N hydrochloric acid to the mark in a 100 $cm^3$ volumetric flask. Reagent grade monobasic phosphate was used to prepare a standard phosphate solution containing 0.01 to 0.02 micromole phosphate per 0.1 $cm^3$ aqueous solution.

The sample to be analyzed was diluted to a working range of phosphate in the 0.01 to 0.20 micromole range. The diluted sample (0.1 $cm^3$) or standard was added to 3.7 $cm^3$ deionized water. Ammonium molybdate solution (0.1 $cm^3$) was then added and the solution mixed. Stannous chloride solution (0.1 $cm^3$) was then added and the solution again mixed. After standing for 10 minutes, the absorbance of the solution at 690 nm was measured.

Reactions involving organophosphinates within the scope of formulae II and III were carried out in a 1 liter 3-neck round-bottom flask equipped with a heating mantle, mechanical stirrer, dropping funnel and water-cooled condenser, water bath cooling being applied as necessary to the flask in order to maintain the reaction mixture at the desired temperature.

In screening tests involving the organophosphinate salts of formula IV, the process was carried out in 40 $cm^3$ vials. The organophosphorous compound and other reactants were added sequentially to a vial. The reaction mixture was heated in a water bath or autoclave for 15 min. The product mixture was analyzed for oxidation product, the standard molybdate calorimetric test being used for orthophosphate where appropriate.

For more extensive investigations involving compounds within the scope of formula IV, a 3-neck round-bottom flask equipped with stirrer and heating mantle was employed. One neck was used for a thermometer to measure the temperature of the reaction mixture and another neck for a water condenser topped with a gas outlet tube passing through a dry ice trap into a gas collector (an inverted graduated cylinder over water).

In cases where oxidation of the phosphinate salts of formula IV were investigated, a weighed amount of aqueous salt was added to the flask. After addition of the appropriate amounts of 40–50% sodium hydroxide and water, the mixture was heated to 80°–85° C. with stirring. Aqueous sodium peroxydisulfate was then added, with cooling as necessary, to maintain the temperature of the reaction mixture below the reflux temperature. Upon completion of the addition, the product was cooled and bottled for orthophosphate

Example 1

Evaluation of Reaction Parameters for VX Nerve Agent

To define the scope and limitations of the oxidation of nerve agent residues from dissolving metal reduction with solvated electrons, small scale reactions were conducted in 40 cc vials as described above. Variables were the amount of persulfate, sodium hydroxide and water. Production of inorganic phosphate was monitored by the standard molybdate calorimetric method. Results in Table I below indicate that phosphate can be produced, but complex interactions of all three variables take place. The amount of persulfare appears to be the dominant variable.

TABLE I

OXIDATION OF VX RESIDUE

| Sample | Persulfate (g) | Hydroxide (g) | Water (g) | $PO_4^E$ (%) |
|---|---|---|---|---|
| 1 | 94.5 | 32.5 | 45.4 | (+) |
| 2 | 48.9 | 17.1 | 45.4 | (+) |
| 3 | 17.5 | 11.8 | 0.0 | (+) |

TABLE I-continued

OXIDATION OF VX RESIDUE

| Sample | Persulfate (g) | Hydroxide (g) | Water (g) | $PO_4^E$ (%) |
|---|---|---|---|---|
| 4 | 8.9 | 5.9 | 21.1 | (+) |
| 5 | 8.8 | 5.7 | 24.6 | (+) |
| 6 | 4.4 | 5.7 | 17.4 | (−) |
| 7 | 4.4 | 3.0 | 10.0 | (−) |
| 8 | 2.9 | 2.0 | 6.4 | (−) |

*VX residue from 040297 destruction used at 1.0 g active

Example 2

Optimization of the reaction was conducted by running sequentially increasing levels of sodium persulfate at constant hydroxide, and then examining increasing hydroxide levels at constant persulfate. Results are provided in Table II which shows these are interacting parameters controlling the complete rupture of the carbon-phosphorus bond. The use of alkaline conditions allows much lower persulfate usage. No advantage accrues by using high temperature/pressure conditions.

TABLE II

EFFECT OF PERSULFATE AND CAUSTIC ON PHOSPHATE FORMATION

| Sample | Persulfate (g) | Caustic (g) | Water (g) | $PO_4^E$ (%) 95° C. | $PO_4^E$ (%) 121° C. |
|---|---|---|---|---|---|
| 1 | 7.6 | — | 71.1 | 0.1 | 0.1 |
| 2 | 15.2 | — | 69.3 | 1.0 | 0.1 |
| 3 | 22.9 | — | 67.7 | 14.4 | 12.7 |
| 4 | 30.6 | — | 66.7 | 57.4 | — |
| 5 | 19.1 | 0.2 | 77.3 | 8.3 | — |
| 6 | 19.1 | 0.7 | 76.6 | 13.3 | — |
| 7 | 19.1 | 7.1 | 70.2 | 39.6 | — |
| 8 | 19.1 | 14.1 | 64.3 | 84.6 | — |

*VX residue from 040297 destruction used at 1.0 g active

Example 3

Design of experiments was used to more clearly define interactions of persulfate, caustic and water. For the eight examples, the following high and low levels were chosen:

| | High | Low |
|---|---|---|
| Persulfate | 10 | 5 |
| Hydroxide | 8 | 4 |
| Water | 35 | 25 |

The results of these reactions are given in Table III below. Statistical workup of the data showed that oxidation is first order in all three species. An increase in persulfate increases phosphate formation; an increase in hydroxide increases phosphate formation, and an increase in water decreases phosphate formation.

TABLE III

OXIDATION OF VX RESIDUE

| Sample | Std | Dsn id | Block | Hydroxide gr Factor | Persulfate gr Factor | Water gr Factor | Phosphate % Response |
|---|---|---|---|---|---|---|---|
| 1 | 5 | 5 | 1 | 4.00 | 10.00 | 25.00 | 63.50 |
| 2 | 3 | 3 | 1 | 4.00 | 5.00 | 35.00 | 0.40 |
| 3 | 8 | 8 | 1 | 4.00 | 5.00 | 25.00 | 0.40 |
| 4 | 7 | 7 | 1 | 8.00 | 10.00 | 25.00 | 78.80 |
| 5 | 2 | 2 | 1 | 4.00 | 10.00 | 35.00 | 8.10 |
| 6 | 4 | 4 | 1 | 8.00 | 5.00 | 25.00 | 4.20 |
| 7 | 1 | 1 | 1 | 8.00 | 10.00 | 35.00 | 75.00 |
| 8 | 6 | 6 | 1 | 8.00 | 5.00 | 35.00 | 0.50 |

Example 4

Because the active temperature range for thermal decomposition of peroxydisulfate is 70 to 85° C. (FMC persulfates), an attempt to achieve improved results was made by continuously adding aqueous sodium persulfate to aqueous alkaline VX residue at 80 to 85° C.

TABLE IV

OXIDATION OF VX AT 80–85° C.

| Sample | Persulfate (g) | Caustic (g) | Water (g) | $PO_4^E$(%) |
|---|---|---|---|---|
| 1 | 4.8 | 3.5 | 16.1 | 3.7 |
| 2 | 4.8 | 7.0 | 21.4 | 8.6 |
| 3 | 9.5 | 7.0 | 31.3 | 100.00 |
| 4 | 9.5 | 3.5 | 26.1 | 51.6 |
| 5 | 9.5 | 1.8 | 23.4 | 11.1 |

*VX residue from 040297 destruction used at 1.0 g active

The data from Table IV would suggest significantly lower levels of persulfate can be used for complete carbon-phosprorus bond breakage.

Example 5

An experiment was conducted using the knowledge gained from work with VX to optimize the oxidation of a GB residue obtained from a dissolving metal reaction using ammoniated (solvated) electrons. The experiment was run to determine interaction effects of persulfate, hydroxide and water. The same values for high and low levels were used as in the case of the VX residue. The results are given in Table V below.

TABLE V

OXIDATION OF GB RESIDUE

| Sample | Persulfate (g) | Hydroxide (g) | Water (g) | $PO_4^E$(%) |
|---|---|---|---|---|
| 1 | 10.0 | 4.0 | 25.0 | 31.8 |
| 2 | 5.0 | 4.0 | 35.0 | 9.2 |
| 3 | 5.0 | 4.0 | 25.0 | 11.8 |
| 4 | 10.0 | 8.0 | 25.0 | 36.9 |
| 5 | 10.0 | 4.0 | 35.0 | 37.9 |
| 6 | 5.0 | 8.0 | 25.0 | 12.3 |
| 7 | 10.0 | 8.0 | 35.0 | 57.3 |
| 8 | 5.0 | 8.0 | 35.0 | 14.7 |

*VX residue from 040297 destruction used at 1.0 g active

Statistical workup of the data from Table V revealed that the oxidation was first order. An increase in persulfate increased phosphate formation; an increase in hydroxide increased phosphate formation, and an increase in water had only a minor effect.

Example 6

For the GB residue, work was conducted to examine the effect of feeding aqueous persulfate to the aqueous alkaline residue at 80° C. Results are given in Table VI. Similar trends to the results with VX residue are noted, and complete C—P bond rupture appears possible.

OXIDATION OF GB RESIDUE AT 80 TO 85° C. BY FEEDING PERSULFATE

| Sample | Persulfate (g) | Caustic (g) | Water (g) | $PO_4^E$ (%) |
|---|---|---|---|---|
| 1 | 5.0 | 2.0 | 15.0 | 3.1 |
| 2 | 5.0 | 4.0 | 20.0 | 14.2 |
| 3 | 10.0 | 4.0 | 30.0 | 36.4 |
| 4 | 15.0 | 3.0 | 40.0 | 44.0 |
| 5 | 15.0 | 8.0 | 50.0 | 89.4 |

Example 7

Oxidation of the Phosphinate Salt Produced by the Dissolving Metal Reduction of VX Nerve Agent The nerve agent VX (14.2 g) was subjected to dissolving metal reduction using sodium metal and anhydrous liquid ammonia as described in the earlier patent. After evaporating the ammonia, the product residue comprised the phosphinate sodium salt of formula IV with $R_1$=$CH_3CH_2$— and $R_2$=$CH_3$— (6.0 g), together with some nitrogenous and sulfur-containing compounds.

The entire quantity of sodium salt was oxidized using the process of this invention. The salt was charged to a 1 liter, 3-neck, round-bottom flask equipped with a heating mantle, magnetic stirring, a gas adapter to direct any off gas into a dry ice trap and any noncondensible into a gas collector, a thermometer, and a condenser cooled with cold water. 10N sodium hydroxide (367.4 g) was added to the flask, and the contents were heated with stirring to 85° C. Drop-wise addition of aqueous 32.5% (w/w) sodium peroxydisulfate (234 g) was then initiated, whereupon an exothermic reaction occurred, heating the flask contents to 100° C. The heating mantle was removed, and addition of the aqueous peroxydisulfate was continued at the rate necessary to maintain the temperature of the reaction mixture at 95°–100° C. The addition required 75 min, at the end of which the pH of the mixture was 11.6. Noncondensible gas (550 $cm^3$) had been collected, and a dark yellow, dense solid precipitate was present in the flask. Analysis of the supernatant liquid by the molybdate method indicated 10% conversion to orthophosphate.

Additional 32.5% (w/w) aqueous sodium peroxydisulfate (234 g) was added with stirring to the reaction mixture at the rate necessary to maintain the temperature of the mixture at 95–100° C. The addition required 45 min, and the mixture was stirred for 10 min after complete addition. Upon completion, the flask contained a light yellow, fluffy solid, and an additional 470 $cm^3$ of noncondensible gas had been collected.

The gross product (841.5 g) was collected and subjected to elemental analysis; the components added to the flask weighed 860.4 g for a 97.8% recovery.

TABLE VII

Element Recovery-VX Residue Oxidation

| Element | Expected | Found | Recovery |
|---|---|---|---|
| Sodium | 107.82 g | 93.41 g | 86.6% |
| Phosphorous | 1.86 | 1.67 | 90.0 |
| Sulfur | 42.68 | 40.64 | 95.2 |

Analysis for orthophosphate by the molybdate test indicated 69% conversion of the VX-derived phosphinate salt to orthophosphate, while analysis by ion chromatography indicated that, within experimental error, all of the phosphorous in the product was in the form of phosphate. NMR analysis indicated a nonquantified amount of methylphosphonic acid was still present in the product. Only 35% of the sulfur in the VX was present as sulfate. GC/MS analysis indicated that >88% of the VX thiol was oxidized by persulfate.

Example 8

Oxidation of the Phosphinate Salt Produced by the Dissolving Metal Reduction of GB Nerve Agent Pursuant to the procedure described in the earlier patent and Example 7 above, the nerve agent GB (11.8 g) was subjected to dissolving metal reduction with sodium metal in anhydrous liquid ammonia, affording the phosphinate sodium salt of formula IV with $R_1$=1-methylethyl and $R_2$=methyl (10.3 g), together with NaF (1.5 g).

A reaction mixture was prepared comprising the entire quantity of phosphinate sodium salt (10.3 g), sodium hydroxide (80.0 g) and water. Sodium peroxydisulfate (158.4 g) in water (total 505.1 g in reaction mixture) was added drop-wise over 1 hr at a rate to maintain the temperature of the reaction mixture between 80° C. and 85° C. The product (749 g) represented a recovery of 97.7%.

TABLE VIII

ELEMENT RECOVERY - GB RESIDUE OXIDATION

| Element | Expected | Found | Recovery |
|---|---|---|---|
| Sodium | 93.6 g | 80.9 g | 86.4% |
| Phosphorous | 2.23 | 1.78 | 79.6 |
| Sulfur | 42.45 | 39.92 | 94.0 |

Within experimental error, all phosphorous in the product was present as inorganic phosphorous, and NMR spectra showed no C—P bonds; 35% of the sulfur was present as sulfate.

Example 9

Oxidation of VX Nerve Agent

To the reaction vessel was added deionized water (500 ml), followed by sodium hydroxide (200 g) with cooling as necessary to keep the temperature below 85° C. While stirring the reaction mixture vigorously at 300 rpm, VX nerve agent (6.7 g) was added to the mixture dropwise while maintaining the temperature at 85° C. After stirring the reaction mixture for 4 hr at 85° C., 32.5% aqueous sodium peroxydisulfate (234 g) was added while maintaining the temperature of the reaction mixture at 85°–95° C. When all the peroxysulfate had been added, the mixture was stirred for 1 additional hour at 85° C. After cooling, analysis of the product by the molybdate method indicated 74% conversion of the VX reactant to sodium orthophosphate.

Example 10

Oxidation of GB Nerve Agent

The procedure of Example 9 was repeated using GB nerve agent (10 g), sodium hydroxide (80 g), and deionized water (250 ml) at 80°–85° C. To this mixture was added sodium peroxydisulfate (450 g) over 2 hrs while maintaining the temperature of the reaction mixture at 85° C.–95° C. Analysis of the product by the molybdate method indicated a quantitative conversion of the GB nerve agent to sodium orthophosphate.

We claim:

1. A process for breaking a carbon-phosphorous bond in an organophosphorous compound having the structural feature:

P—C and selected from the group of organophosphorous compounds with structures consisting of

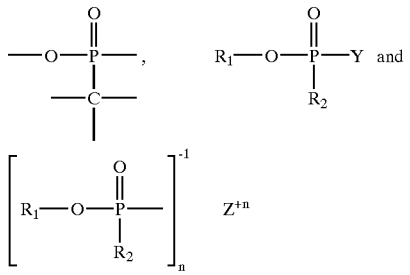

and mixtures thereof in which $R_1$ is selected from the group consisting of hydrogen and alkyl, $R_2$ is independently selected from alkyl, Y is a leaving group, and Z is a cation of charge n, which process comprises (1) creating a reaction mixture consisting essentially of said organophosphorous compound, a base and a peroxysulfate of the formula:

$M_2S_xO_y$ in which M is a monovalent cation, x is 1 or 2, y is 5 when x is 1, and y is 8 when x is 2, said reaction mixture having a pH>7, and (2) reacting said mixture.

2. The process of claim 1 wherein M is selected from the group consisting of $Na^+$, $K^+$ and $NH_4^+$ and the pH of the reaction mixture ranges from about 8 to about 12.

3. The process of claim 2 wherein M is $Na^+$, x is 2 and y is 8.

4. The process of claim 1 wherein said reaction mixture includes water, and is conducted at elevated temperature.

5. The process of claim 1 wherein said organophosphorous compound includes the structure:

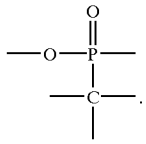

6. The process of claim 5 wherein said organophosphorous compound is a phosphinate of the formula:

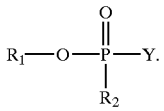

7. The process of claim 6 wherein $R_1$ is selected from the group consisting of hydrogen, $C_1$–$C_6$, straight chain, branched and cyclic alkyl, $R_2$ is selected from the group consisting of $C_1$–$C_6$, straight chain, branched and cyclic alkyl, and Y is selected from the group consisting of halogen, nitrile and sulfide.

8. The process of claim 6 wherein said phosphinate is a chemical warfare agent selected from the group consisting of GB, GD and VX.

9. A process for breaking a P—$R_2$ bond in a phosphinate salt of the formula:

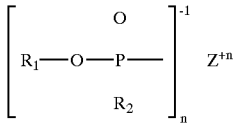

in which $R_1$ is selected from hydrogen and alkyl, $R_2$ is independently selected from alkyl, and Z is a cation of charge n, which comprises (1) creating a reaction mixture consisting essentially of said organo-phosphinate, a base and a peroxysulfate of the formula:

$$M_2S_xO_y$$

in which M is a monovalent cation, x is 1 or 2, y is 5 when x is 1, and y is 8 when x is 2; said reaction mixture having a pH>1, and (2) reacting said mixture at elevated temperature conditions.

10. The process of claim 9 wherein M is selected from the group consisting of $Na^+$, $K^+$ and $NH_4^+$ and the pH of the reaction mixture ranges from about 8 to about 12.

11. The process of claim 10 wherein M is $Na^+$, x is 2 and y is 8.

12. The process of claim 9 wherein said reaction mixture includes water.

13. The process of claim 9 wherein said reaction mixture is created by combining about 5–200 g water, about 5–100 g peroxysulfate, and from about 2 to about 50 g base with about 1.0 g of said phosphinate salt.

14. The process of claim 9 wherein said phosphinate salt is produced by a dissolving metal reduction of a phosphinate of the formula:

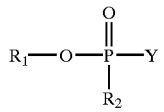

in which $R_1$ is selected from hydrogen and alkyl, $R_2$ is independently selected from alkyl, and Y is a leaving group.

15. The process of claim 14 wherein M is selected from the group consisting of $Na^+$, $K^+$ and $NH_4^+$, and the pH of the reaction mixture ranges from about 8 to about 12.

16. The process of claim 15 wherein said reaction mixture is created by combining about 5–200 g water, about 5–100 g peroxysulfate, and up to about 50 g sodium hydroxide, together with about 1.0 g of said phosphinate salt.

17. The process of claim 15 wherein said phosphinate salt is produced in a dissolving metal reduction with solvated electrons.

18. A process for breaking a P—$R_2$ bond in a phosphinate salt of the formula:

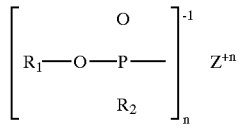

in which $R_1$ is selected from hydrogen (and alkyl, $R_2$) is independently selected from alkyl, and Z is a cation of charge n, which comprises (1) creating a reaction mixture consisting essentially of 1.0 g of said phosphinate salt with
(a) about 5–100 g of a peroxydisulfate
(b) about 5–200 g water; and
(c) a sufficient amount of a base to provide a pH>7; and (2) reacting said mixture.

19. A process for oxidizing a phosphorous-containing product from a dissolving metal reduction of a phosphinate of the formula:

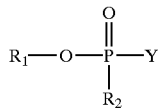

in which $R_1$ is selected from hydrogen and alkyl, $R_2$ is independently selected from alkyl, and Y is a leaving group, which process comprises treating said phosphorous-containing product with a reaction mixture consisting essentially of peroxysulfate of the formula:

$$M_2S_xO_y$$

in which M is a monovalent cation, x is 1 or 2, y is 5 when x is 1, and y is 8 when x is 2, said process conducted at an alkaline pH.

20. The process of claim 19 wherein M is selected from the group consisting of $Na^+$, $K^+$ and $NH_4^+$.

21. The process of claim 20 wherein M is $Na^+$, x is 2 and y is 8.

22. The process of claim 19 wherein said reaction mixture includes water, and is conducted at elevated temperature.

23. The process of claim 1 wherein the reaction is conducted at a temperature of about 70° to about 85° C.

* * * * *